United States Patent [19]

Motta

[11] Patent Number: 4,862,925

[45] Date of Patent: Sep. 5, 1989

[54] METHOD FOR WEAVING A CROSS-WOVEN TEXTILE FABRIC

[76] Inventor: Carmelo Motta, Via F. Baracca, 22 - 20052 Monza (Milan), Italy

[21] Appl. No.: 74,062

[22] Filed: Jul. 16, 1987

[30] Foreign Application Priority Data

Jul. 18, 1986 [IT] Italy ..... 21178 A/86

[51] Int. Cl.[4] ..... D03C 7/00

[52] U.S. Cl. ..... 139/50; 139/46; 139/419

[58] Field of Search ..... 139/46, 50–54, 139/419

[56] References Cited

U.S. PATENT DOCUMENTS

| | | | |
|---|---|---|---|
| 672,393 | 4/1901 | Buckler | 139/46 |
| 841,087 | 1/1907 | Hannah | 139/53 |
| 1,416,410 | 5/1922 | Norris | 139/51 |
| 1,757,947 | 5/1930 | Snow | 139/50 |

FOREIGN PATENT DOCUMENTS

| | | | |
|---|---|---|---|
| 773 | of 1913 | United Kingdom | 139/51 |

*Primary Examiner*—Henry S. Jaudon

*Attorney, Agent, or Firm*—Cushman, Darby & Cushman

[57] ABSTRACT

A warp is prepared including a stationary thread, a crossing thread and an auxiliary thread, the latter two of which are laterally interlaced at a sliding connection and subject to being alternately tensioned and released for causing the crossing thread to cross across the stationary thread, and cross back, as conventional loom equipment is manipulated to create a succession of sheds into which wefts are inserted to weave a cross-woven textile fabric. As the weaving is being accomplished, a separating element is provided to prevent the sliding connection of the crossing and auxiliary threads from sliding so far towards the reed as to become incorporated in the fabric. The stationary or auxiliary thread may actually be constituted by a metal or other non-textile element, which is pulled out of the fabric as the fabric, having been woven, is moved downstream on the loom.

3 Claims, 6 Drawing Sheets

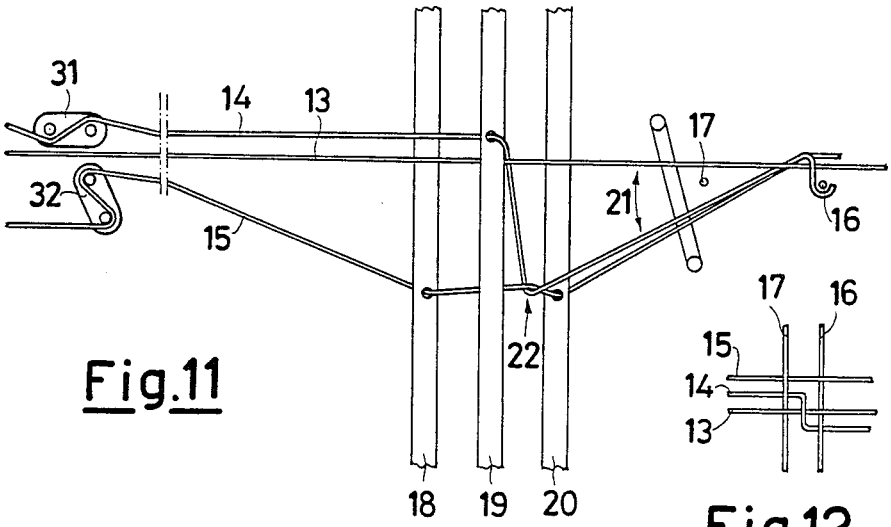
Fig.11
Fig.12
Fig.13
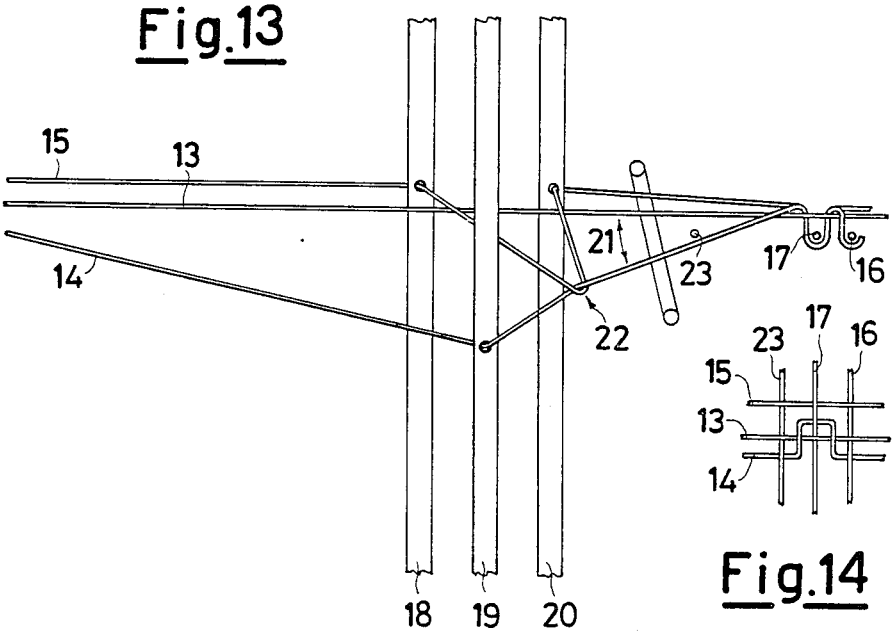
Fig.14

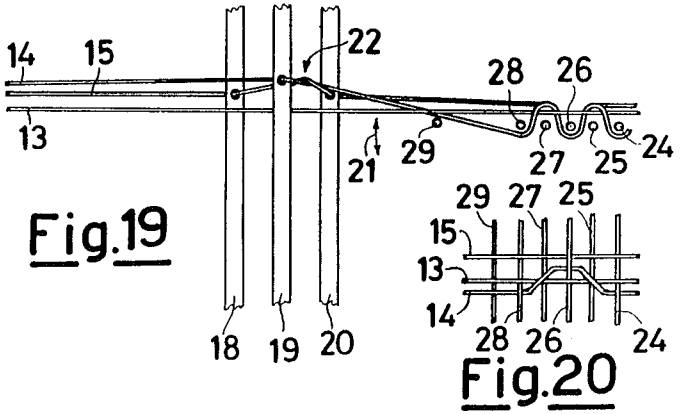
Fig.19
Fig.20
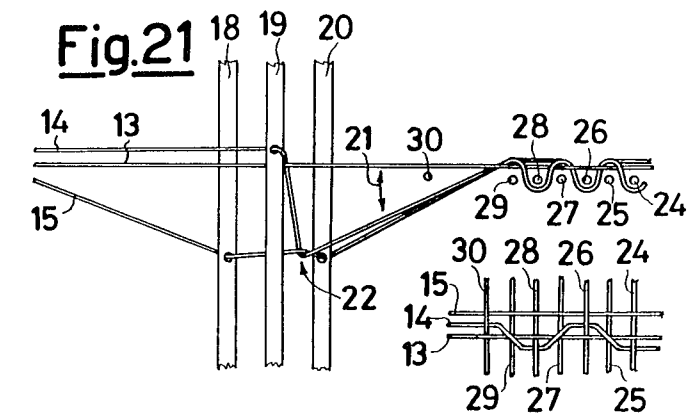
Fig.21
Fig.22
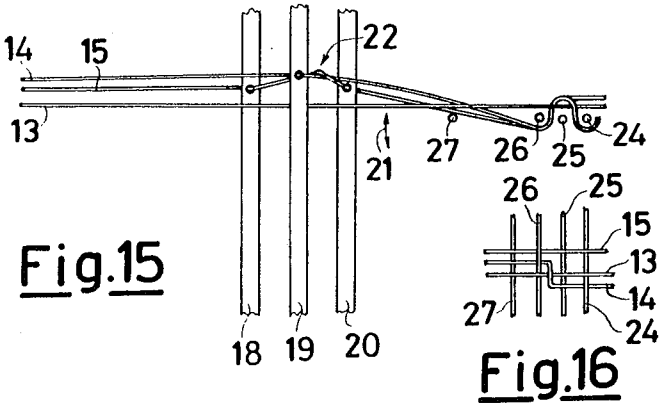
Fig.15
Fig.16
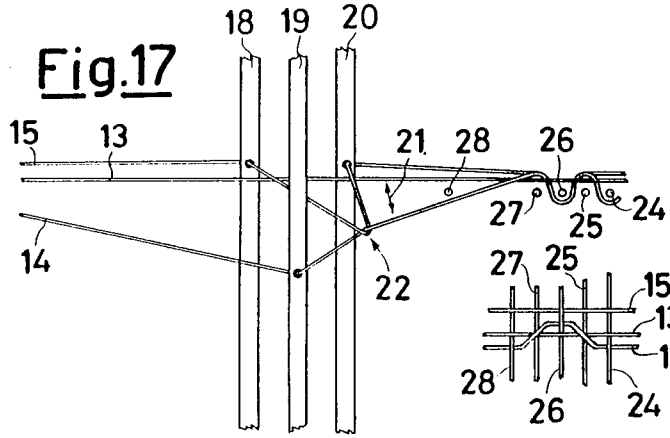
Fig.17
Fig.18

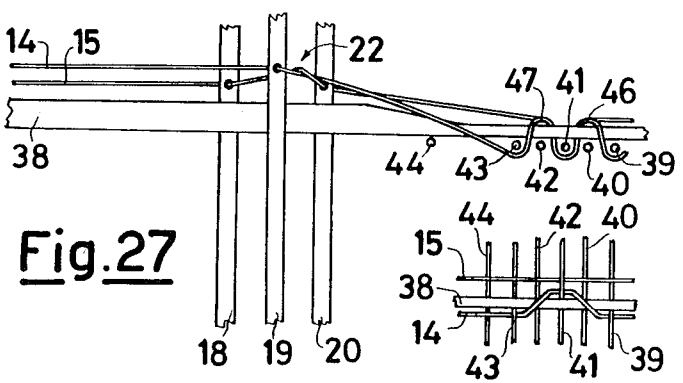
Fig.27
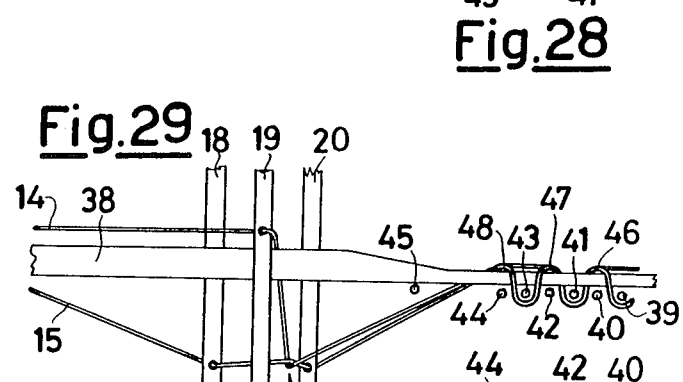
Fig.28
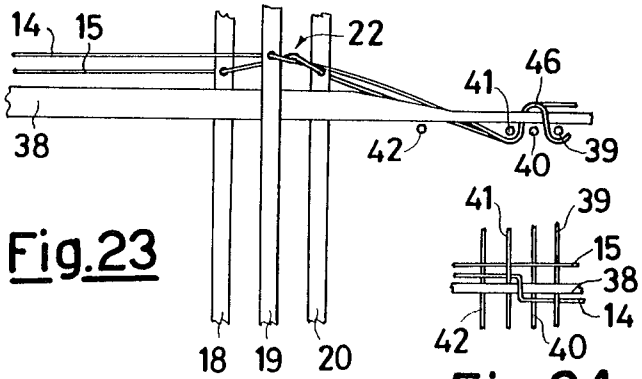
Fig.23
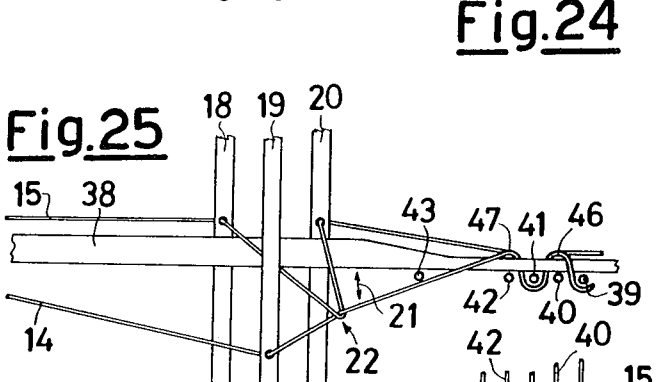
Fig.24
Fig.29
Fig.30
Fig.25
Fig.26

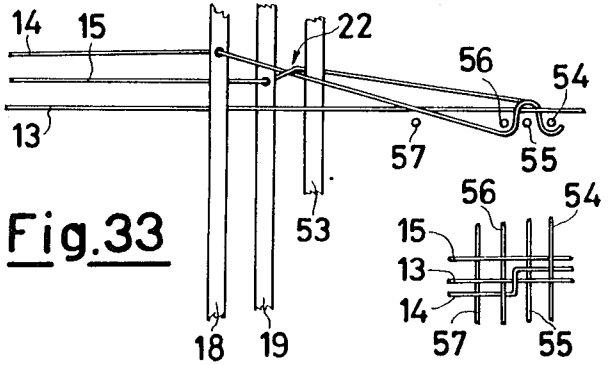
Fig.33
Fig.34
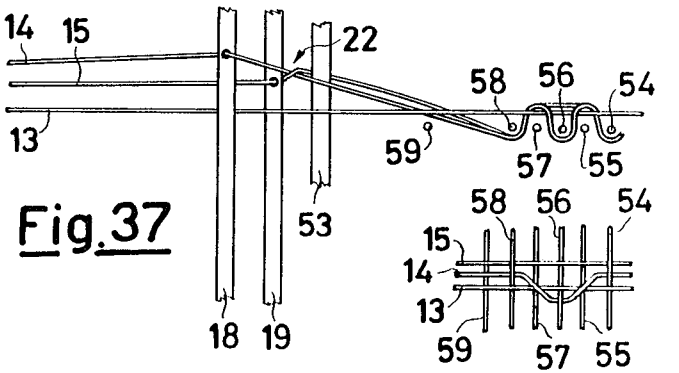
Fig.37
Fig.38
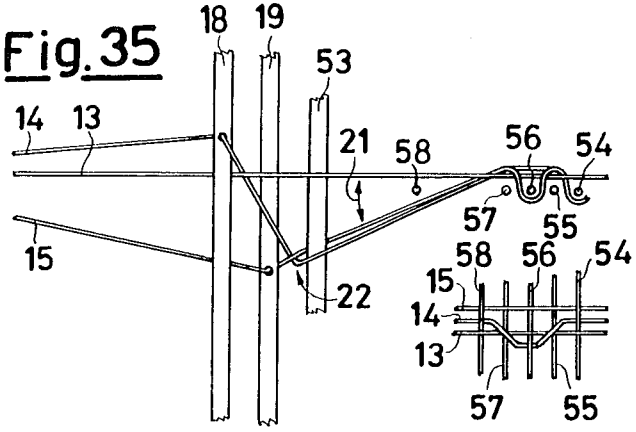
Fig.35
Fig.36
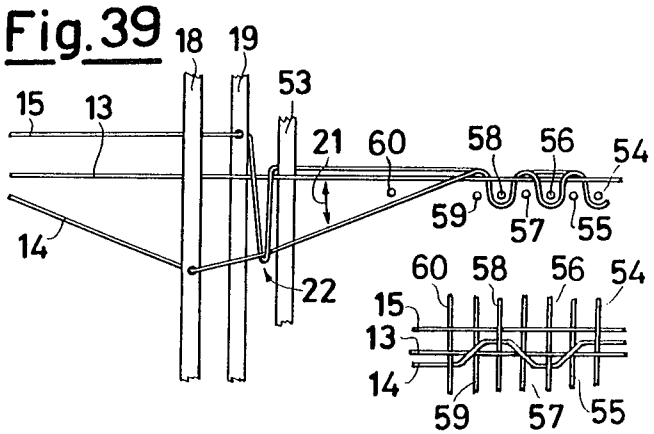
Fig.39
Fig.40

Fig.31
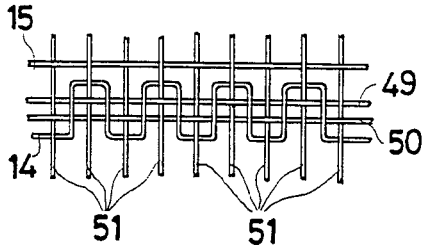
Fig.32
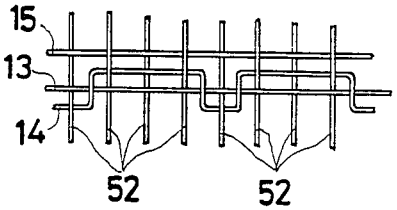
Fig.41
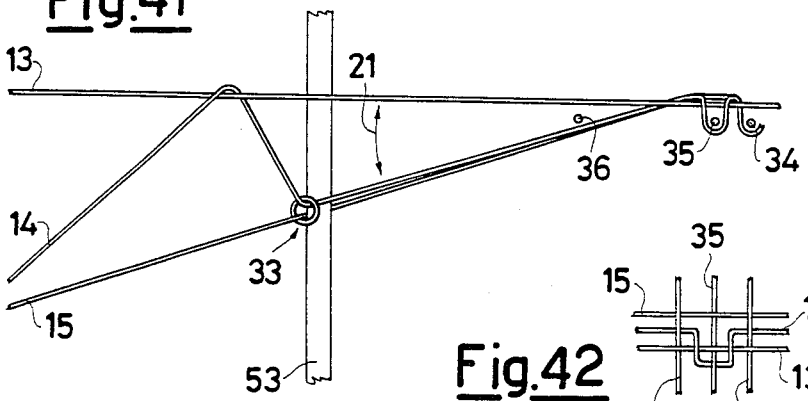
Fig.42
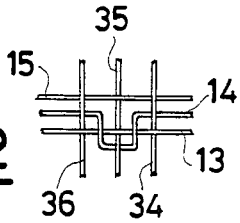
Fig.43
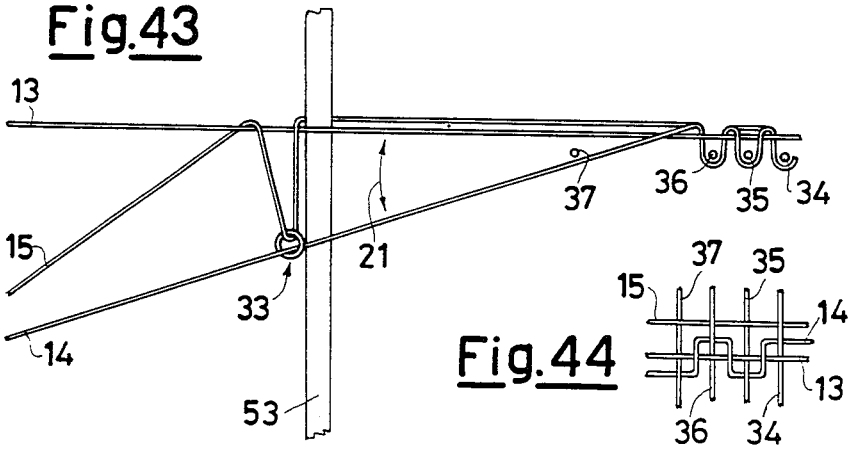
Fig.44

METHOD FOR WEAVING A CROSS-WOVEN TEXTILE FABRIC

BACKGROUND OF THE INVENTION

The present invention relates to a simplified method for accomplishing a textile interlacement of the so-said "gauze type".

The term "textile interlacement of the gauze type", as used herein refers to an interlacement wherein the warp threads and the pick threads intercross at a right angle, and two or more adjacent warp threads twist around each other, taking an oblique position.

A method is known by which, for the purpose of providing a gauze-type textile interlacement, uses healds (i.e., heddles), denominated as "Leno cloth healds". Such healds, by means of the mechanical action of the three elements which compose them, are able to cause a thread, namely, one denominated a "twist thread", namely, one and another thread, denominated a "straight thread" to twist around each other. There two warp threads are the minimum elements essential for providing a textile interlacement of the gauze type.

The weaving loom on which said interlacing must be accomplished by means of the leno cloth units must be pre-arranged, in its turn, for special and pre-selected strokes of the heald frames. Both these strokes and the types of movements which the elements composing the leno cloth units (in particular, the gauze heald, or eye heald), particularly for modern looms which can operate at a rate exceeding 3,000 picks per minute, limit the operating speed to less than half that value.

Other limitations, directly connected with the use of the leno cloth units, are:

the minimum distance of approximately 12 cm, which it is necessary to leave between the normal healds which drive the twist thread and the straight thread and the healds of the same unit, to allow the required operation to be duly executed;

the considerable thickness of the unit, and the total number of the healds. In fact, for the simplest interlacing pattern, five healds are needed, i.e., three for the unit and two normal control healds. For fabrics with many threads twisting into a gauze pattern, this means operating with great difficulty, and having to distribute a large number of healds on many frames.

SUMMARY OF THE INVENTION

The purpose of the method according to the present invention is to find a solution to the intrinsic limitations of the method of the prior art, thus enabling the actual possibilities of the moder looms to be fully exploited, while offering the same possibilities and flexibility of operation of the traditional systems.

These puroses, according to the present invention, are achieved by providing a simplified method for accomplishing a textile interlacement of the so-said gauze type. According to the method of the present invention, the known function of the traditional heald set constituting the leno cloth unit, is replaced by a simple sliding tie between the two warp threads. These two warp threads will be referred to herein, respectively, by the terms "twist thread" or "winding thread", and "auxiliary thread". The auxiliary thread is one which is at least temporarily inserted in the fabric, downstream from the sliding tie. An element is provided, which performs the functions of separating the two warp threads and preventing the sliding tie from moving forwards in the direction of formation of the fabric. The two warp threads move, upstream of said sliding tie, on opposite planes relative to an element which is referred to herein by the term "straight element", which is at least temporarily inserted in the fabric, free of performing any independent textile interlacement of its own. The twist thread twists around the straight element according to pre-settable sequences, so to provide the gauze interlacement.

To provide the sliding tie, any contrivance should be considered, which is suitable for keeping the auxiliary thread and the straight thread close to each other, so as to allow them to freely slide relative to each other. In preferred forms of the practical embodiment, the sliding tie can be a simple crossing between the two warp threads, or an added element, which keeps them close to each other, while being free of sliding relative to each other.

In accordance with the principles of the present invention, it appears clear that the elements which constitute the fabric, essential for providing the gauze interlacement, have increased from two to three, in as much as, to the straight thread and to the twist thread, an auxiliary thread is added. Also, the auxiliary thread, by being not structurally essential for constituting the desired interlacement, but its function being exploited during the production step only, could be a thread, or a fixed and flexible mandrel which separates from the fabric being formed, as this fabric advances.

A preferred form of practical embodiment of the manufacturing method of the present invention provides the use of a normal weaving loom, pre-arranged, according to known techniques, with more or less sophisticated devices for varying the feed of all, or, at least, a portion of the threads involved in the gauze-type interlacement.

BRIEF DESCRIPTION OF THE DRAWINGS

The method of the invention is hereunder disclosed in greater detail by referring to the attached drawings which illustrate, for illustrative and non-limitative purposes, some interlacements which can be accomplished by taking advantage of the teachings and the practical embodiment of said method.

FIGS. 11 and 13 show how the gauze interlacement shown in FIGS. 1–4 can be accomplished using the method of the present invention;

FIGS. 12 and 14 are views of the weave diagram relating to FIGS 11 and 13.

FIGS. 15, 17, 19 and 21 show a process necessary, according to the present invention, for carrying out a twisting of the straight thread and of the twist thread every two picks, while the auxiliary thread binds itself to the pick every four picks (three picks yes, one pick no);

FIGS. 16, 18, 20 and 22 are the weave diagrams relating to the positions shown in FIGS. 15, 17, 19 and 21;

FIGS. 23, 25, 27 and 29 show how it is possible to accomplish the interlacement of FIGS. 15, 17, 19 and 21 by replacing the straight thread with a fixed mandrel, which separates from the fabric as the fabric is produced, and hence advances;

FIGS. 24, 26, 28 and 30 are the weave diagrams relating to the positions shown in FIGS. 23, 25, 27 and 29;

FIGS. 31 and 32 show two further possible interlacements which can be accomplished by the method of the present invention;

FIGS. 33, 35, 37 and 39 show how it is possible to achieve, according to the method of the present invention, a different sequence which has the purpose of accomplishing a textile interlacement identical to that accomplished using the sequence shown in FIGS. 15, 17, 19 and 21;

FIGS. 34, 36, 38 and 40 are the weave diagrams relating to the positions shown in FIGS. 33, 35, 37 and 39;

FIGS. 41 and 43 show a further example of the flexibility of the method according to the invention, wherein the accomplishment of the method is left to the action of an added annular element accomplishing the sliding tie of two threads and to a change in the feeding of these two threads; and FIGS. 42 and 44 are the weave diagrams relating to the positions shown in FIGS. 41 and 43.

DETAILED DESCRIPTION

Figure 1:
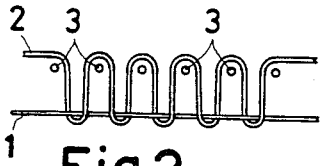
FIGS. 1 and 2 are a graphic theoretical view respectively of the warp profile, and of the related weave diagram, relating to two threads which constitute a textile interlacement of the most simple and classic gauze type, wherein the straight thread does not tie with the picks.
Figure 2:
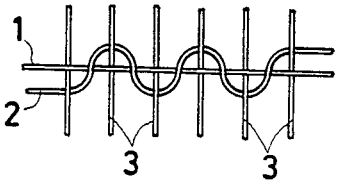

Referring to FIGS. 1 and 2, the theoretical mutual position is shown in the case of a classic gauze interlacing, wherein a thread 1, denominated the straight thread (i.e., stationary thread), bears, twisted around it, a thread 2, denominated the twist thread of winding thread (i.e., crossing thread).

FIG. 1, which is a view of the warp profile, shows a characteristic, not essential, of the straight thread, which remains always on one side relative to the weft. The weft is indicated by the numeral 3, in the form of its various picks, around which the twist or winding thread 2 interlaces. The weave diagram of FIG. 2 makes it possible to better observe the characteristic, essential for the gauze interlacing, of the twist thread 2, which twists around the straight thread 1. The twist thread 2 alternatively shifts, according to predetermined sequences, to one side and to the other side of the same straight thread. The action of this twisting, as it can be easily understood, fixes on the fabric these two threads much better than the same two threads, running parallel to each other and tying with the picks, would do. It is exactly this arrangement, including crossing, which characterizes a gauze-type interlacement. In fact, the same word "gauze" relates to a fabric wherein groups of two warp threads, spaced apart from each other by as much as a plurality of millimeters, if were not fixed by means of the interlacement to the picks, would slide on the picks, thereby causing the aimed textile interlacement being hence lost.

Figure 3:
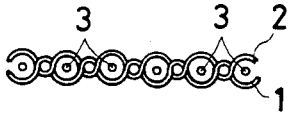
FIGS. 3 and 4 views of the actual disposition that the two warp threads assume in practice when they are interlaced to form a gauze fabric, respectively according to the warp profile of FIG. 1 and the weave diagram of FIG. 2.
Figure 4:
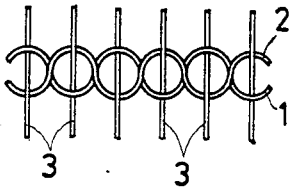

FIGS. 3 and 4 show how the straight thread 1 and the twist thread 2 position themselves in practice, due to the effect of the tensions and of the natural flexibility of the threads which constitute the textile interlacement.

Figure 5:
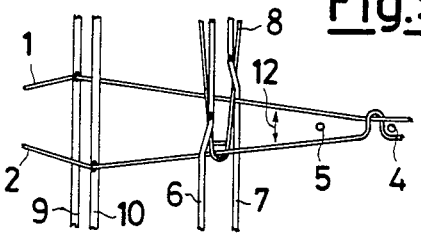
FIG. 5 shows a schematic view of a working position, or step, necessary for obtaining the gauze interlacement by means of a well-known leno cloth unit.
Figure 6:
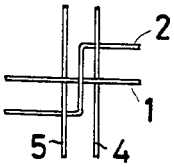
FIG. 6 is the weave diagram relating to the position shown in 5.

The function of the leno cloth heald set of the prior art to accomplish a gauze interlacement is clarified with reference to FIGS. 5 to 10. In FIGS. 5 and 6, a necessary step for the purpose of accomplishing the desired interlacement is shown. In this step, the straight thread 1 is, looking at the figure, on a rear plane relative to the plane on which the twist thread 2 lays, more precisely, between an eye heald 8 and a guide heald 7.

The twist thread 2 passes through the eye of the eye heald 8, and they are both kept on the opposite sides of a shed 12, due to the action of normal healds 9 and 10. The pick 5 therefore becomes placed under the straight thread 1 and above the twist thread 2, as can be better observed in FIG. 6, wherein the end position of the pick 5 is shown.

Figure 7:
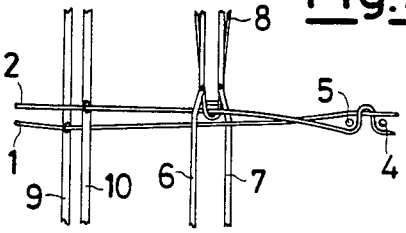
FIG. 7 shows a working position following the position shown in FIG. 5, and intermediate in the accomplishing of the gauze interlacement.
Figure 8:
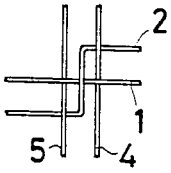
FIG. 8 is the weave diagram relating to the position shown in FIG. 7.
Figure 9:
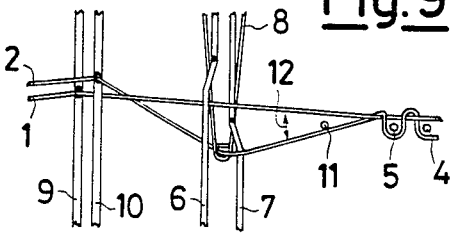
FIG. 9 shows an end working position relatively to those of FIGS. 5 and 7.
Figure 10:
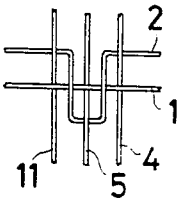
FIG. 10 is the weave diagram relating to the position shown in FIG. 9.

In an intermediate position, evidenced by FIGS. 7 and 8, it can be observed how the straight thread 1 has moved downwards, while the twist thread 2 has moved upwards. The eye heald 8 has moved upwards, and, after the consequent movement of the other healds, when moving again downwards, the eye heald 8 guides the twist thread 2 so that the crossing thread 2 therefore becomes placed on a rear plane relative to that on which the straight thread 1 lays. FIGS. 9 and 10 show this last step of movement of the healds, besides showing the end configuration of the weave diagram. As the eye heald 8 moves downwards and the normal heald 9 moves upwards, the twist thread 2 and the straight thread 1 place themselves once again on opposite sides relative to the shed 12. A new pick 11 is inserted, always under the straight thread 1 and above the twist thread 2, thus accomplishing the end step of the desired interlacement.

Both with the traditional system, and with the method as provided according to the present invention, the interlacement variations are, of course, countless. The straight thread can, in fact, interlace with the picks according to any needs and predetermined sequences, instead of remaining always on the same side relative to them. The same twist thread 2 can cross the straight thread 1 according to predetermined and required sequences, and, inside of this interlacement, further warp threads can move and interlace.

The advantages which are inherent in the method according to the present invention make it possible to accomplish the same interlacement diagram as shown in FIG. 10, as is accomplished according to a traditional process, by using the operations shown in the Figures from 11 to 14.

The auxiliary thread 15 is an element which increases to a total of three, during the weaving step, the number of threads essential to accomplish the gauze interlacing, even if, later on, in the textile interlacement which is obtained, the auxiliary thread, having been removed does not remain a part thereof. Exactly due to this reason, the auxiliary thread is defined as being "auxiliary". The auxiliary thread is a service thread and can, should it represent an obstacle for the accomplishment of the desired fabric, be reduced to a simple flexible mandrel rearwardly fastened onto a stationary member of the machine, extending at least along a length inside the thus formed fabric, and being removed from the fabric during the fabric production advancement movement.

As can be seen in FIG. 11, a twist or winding thread 14 and an auxiliary thread 15 are positioned in the textile interlacement, looking at the Figure, behind a straight thread 13. The twist thread 14, slipped through the eye of a heald 19, positioned, in this step, in an upper position, due to a crossing 22, which is, here, a sliding tie, is brought into the lower portion of a shed 21. The mutual position of the threads can be easily observed also in FIG. 12.

Two further healds 18 and 20 move together, and could be advantageously replaced by one single heald with two eyes, or by a heald with one single eye, from which the auxiliary thread 15 exits, and into which it enters again, after interlacing with the twist thread 14. The heald 20, located between the heald 19 carrying the twist thread 14 and the reed R, also functions as a separating element which prevents the sliding connection from sliding into the reed.

More or less sophisticated methods and/or pieces of equipment, denominated "recovery methods/equipment", exemplified in FIG. 11 with 31 and 32, vary, upstream from the interlacement 22, both the feed of the auxiliary thread 15 and the feed of the twist thread 14, running on opposite planes relative to the straight thread 13, so as to tension, or release the auxiliary and twist threads according to the required and predetermined sequences.

In the sequence represented by FIG. 11, it is clear that the auxiliary thread 15 must be taut to be able to pull downwards the twist thread 14. The twist thread 14, consequently, must be released and abundant. In FIG. 13, and in the related weave diagram of FIG. 14, it can be seen how, when the healds 18 and 20 move upwards and the heald 19 moves downward, while, at the same time, the twist thread 14 is tensioned, and the auxiliary thread 15 is released, the twist thread 14 performs the second step of the interlacement. While performing this second step, the twist thread 14 moves looking at the figure, in front of the straight thread 13, coming to the lower portion of the shed 21, so as to allow the insertion of a pick 23. FIG. 14 evidences the result in the fabric, wherein the twist thread 14 and the straight thread 13 accomplish the gauze interlacement, while the auxiliary thread 15 interlaces with the picks 16, 17, 23, according to the predetermined sequence.

FIGS. from 15 to 22 are characterized in that the straight thread 13 and the twist thread 14 interlace with each other every second pick.

Such a different pattern is accomplished due to the two steps shown in FIGS. 15 and 19. In these two steps, as it can be observed, a pick 27 insertion and a pick insertion 29 are respectivelly accomplished, while the twist thread 14 and the auxiliary thread 15 remain in the upper portion of the shed 21. In these two steps, the crossing and auxiliary threads will both be taut.

The steps shown in FIGS. 17 and 21 are similar to those examined in FIGS. 13 and 11. In the resulting weave diagram, shown in FIG. 22, one can see how, by the disclosed sequence, beside the above-disclosed interlacement between the straight thread 13 and the twist thread 14, an interlacment of the auxiliary thread 15 with the pick can be obtained. This causes the auxiliary thread to run above three picks and under one pick per each complete sequence. Thus, it can be understood how the auxiliary thread 15 is caused to run under the picks 26 and 30 together with the twist thread 14, and above the picks 24, 25, 27, 28 and 29, which are inserted when the twist thread 14 itself is caused to run above said picks, or under them, but on the other side relative to the straight thread 13.

In FIGS. from 23 to 30, a particular case has been illustrated, which is useful for the production of the hook tapes and of the corresponding loop fastening tapes. When coupled, hook tapes and loop fastening tapes form said "hook" fasteners. The hook tape is manufactured on a loom, in the form of a loop tape its loops are formed by a plastic monofilament, and whose hooks are provided in a further production step by cutting the loops. In this case, the straight thread is replaced by a mandrel constituted by a suitably shaped steel strap constrained onto a stationary member of the loom upstream from the healds, more or less extending inside the fabric. The mandrel is removed from the fabric during, and due to, the advancing motion of the fabric, in the production movement thereof.

The textile interlacement taken into consideration in Figures from 23 to 30 is the same as already illustrated in the group of Figures from 15 to 22.

The crossing 22 between the twist thread 14 and the auxiliary thread 15 causes these two threads, due to the combined effect also of the change in their feed and of the movement of the healds 18, 19 and 20, to run sideways relatively to the mandrel 38, producing, with the picks 39, 40, 41, 42, the interlacement shown in the end weave diagram of FIG. 30.

The loops which are successively formed around the mandrel 38, here indicated by the numerals 46, 47 and 48, become unstrung from the mandrel as the mandrel comes off the fabric. These loops thus constitute on the surface of the fabric, loops, whose size is a function of the dimensions of the mandrel 38 and of the feed rate of the twist thread 14 which constitutes them.

FIGS. 33, 35, 37 and 39, together with the related theoretical weave diagrams of FIGS. 34, 36, 38 and 40, served to clarify, by means of the illustration of a further possible form of practical embodiment of the method of the invention. This further embodiment has as its end result a weave diagram identical to that as already obtained by means of the sequence shown in FIGS. from 15 to 22. FIGS. 33–40 also illustrate the essential function performed by the crossing of the auxiliary thread 15 and of the twist thread 14, as well as the criterion for defining its possible positions.

In this case, it can be observed how the crossing 22 between the auxiliary thread 15 and the twist thread 14 is positioned, on considering that the advancement motion of the threads, looking at the figures, is from the left to the right side, downstream from the last passages of the two threads 14 and 15 taken into consideration in the respective healds 18 and 19. In compensation, the presence can be observed of a spacer (or separating) element, e.g., a stationary bar 53, which performs the functions of keeping the threads 14 and 15 spaced apart from each other after their crossing, of not allowing the crossing to run forwards together with the advancing of the same threads (because in that case the crossing would be absorbed by the fabric which is being formed, thus reconstituting the mutual parallelism of the two threads) and of allowing the same crossing to freely slide on its surface in the direction of its axis. The stationary bar or separating element 53 is located perpendicularly to the weaving plane, downstream of the healds and upstream of the reed.

Due to the aid of such actions, always in combination with the movements of the healds 18 and 19 and with the feed changes, which release and tension the threads 14 and 15 at the predetermined and suitable time points, from an examination of the Figures one can understand how the method is practically embodied in this case.

In FIG. 33, the understanding of which is made easier by the contemporaneous examination of the relevant theoretical weave diagram reported in FIG. 34, the twist thread 14 and the auxiliary thread 15 are both in the high position of the shed 21. The twist thread 14 and the auxiliary thread 15 are kept in the high position of the shed 21 by the lifting of the healds 18 and 19. Also, the crossing 22 between them is positioned in the high side, resting on the surface of the bar 53.

After a pick 57 is inserted, the heald 19 in which the auxiliary thread 15 is taut, sinks, and the twist thread 14 is released. The combination of these events causes the crossing 22, by sliding downwards along the bar 53, to come to the low position of the shed 21, bringing with it the twist thread 14, on a plane behind the plane on which the straight thread 13 lays, when looking at figure.

In FIG. 37 it can be observed how the lifting of the heald 19 causes the crossing 22 to slide upwards, and the crossing 22 to consequently to return to a position similar to that shown in FIG. 33.

In FIG. 39, on the contrary, the sinking of the twist thread 14 and its getting tensioned in the front plane relatively to the plane on which the straight thread 13 lays, caused by the movement of the heald 18, due, also, to the becoming released of the auxiliary thread 15, causes the crossing 22 to be detached from the bar 53, which is behind the straight thread 13. Thus, a pick 59 is enabled to fix the twisting of the twist thread 14 around the straight thread 13 (see also FIG. 40).

FIGS. 41 and 43, besides the related weave diagrams shown in FIGS. 42 and 44, show the extreme simpleness and flexibility which can be achieved by using the method according to the present invention.

A weave diagram identical to that accomplished by using the method disclosed with reference to FIGS. 11 to 14, is attained in the embodiment of FIGS. 42–44 by means of the action of the feed changes, as well as of the sliding tie between the twist thread 14 and the auxiliary thread 15. In this case, the weave diagram is accomplished by means of an added element 33, which keeps the two threads 14 and 15 close to each other. The added element 33 is exemplified by a ring-shaped element.

Both the auxiliary thread 15 and the twist thread 14 are made to come from fixed positions, such as to cause them to lay, although on opposite sides relative to the straight thread 13, in the lower portion of the shed 21. In this case, the simple alternating of the two threads 14 and 15 in the conditions wherein the one is taut and the other one is released and abundant, and, vice-versa, accomplishes the two situations as illustrated in FIGS. 41 to 44.

In FIG. 41, the auxiliary thread 51 is taut and its position and coming direction, by causing it to place itself in a rectilinear configuration in the low portion of the shed 21, behind the straight thread 13 and the spacer bar 53, cause the ring-shaped element of tie 33 to slide with it along the spacer bar 53, and, as a consequence, the twist thread 14 too.

In FIG. 43 a contrary situation is illustrated: the twist thread 14 is taut; it comes from and is situated on a front plane relative to the plane on which the straight thread 13 lays, and lowers the auxiliary thread 15 by means of the ring-shaped joining element 33, also due to the release and the abundance of the same auxiliary thread. Thus, a loop forms in the auxiliary thread 15, which runs downwards in front of the straight thread 13 to the ring-shaped joining element 33. Accordingly, a pick 37 enters the shed 21 under the straight thread 13 and the auxiliary thread 15, but above the twist thread 14.

FIG. 31 shows the theoretical weave diagram relating to a case wherein the straight thread has been replaced by two warp threads 49 and 50 accomplishing a predetermined interlacement of their own with the picks 51. The twist thread 14 twists in this case around these two threads 49 and 50, while the auxiliary thread 15 interlaces with the picks sideways to this set of threads 14, 49 and 50.

Finally in FIG. 32, a case is illustrated, wherein the twist thread 14, interlacing with the straight thread 13, performs evolutions which, relative to the straight thread, do not have a symmetrical configuration in the interlacement which they constitute together with the picks 52. For these two last cases, the whole production sequence of the Figures illustrating the several production steps has not been repeated, in that, on the basis of the preceding explanations, the procedure to be followed can be easily understood.

It is understood, however that the method according to the present invention not only does not limit the interlacement and the structure of the fabric which can be obtained, as well as the system for the changing of the feed of the warp threads, but not even any obtainable characteristics.

Such a method is essentially characterized by the presence of one or more crossings between the twist threads and the auxiliary threads. The possibility of accomplishing the gauze interlacing in all of its possible and imaginable variants is only due to the provision of one or more of such crossings.

We refer to more than one crossing between the auxiliary thread and the twist thread in that particular case in which the different function of one of them relatively to the other cannot be determined in that both of them can alternatively perform the function, according to predeterminable sequences, of the auxiliary thread and of the twist thread, both of them accomplishing hence the gauze interlacement around the straight element or elements.

The same one sliding crossing or tie between the twist thread and the auxiliary thread can be accomplished in several ways and positions. One essential characteristic is that each tie or crossing perform the illustrated functions, to obtain the gauze textile interlacement by means of the twisting of the twist thread around the straight element by the auxiliary thread. The sliding crossing or interlacement is maintained during the production by the action of separating elements (heald, bar, simple thread, and so forth) which, by keeping the auxiliary thread and the twist thread spaced apart downstream the said sliding crossing or tie, prevents the sliding crossing or tie from advancing and being consequently absorbed by the fabric. In fact, in this latter case, as already mentioned, the auxiliary thread and the twist thread would be rendered parallel to each other, so as to nullify the operativity of the method according to the invention.

What is claimed is:

1. A method for weaving a cross-woven textile fabric, comprising:

providing a warp including:

(a) at least one substantially longitudinally-running stationary thread which is movable perpendicularly relative to a weaving plane;

(b) at least one crossing thread associated with at least one said stationary thread, each said crossing thread being movable transversally so as to cross a respective said stationary thread, and each said crossing thread being movable perpendicularly relative to said weaving plane; and (c) at least one auxiliary thread associated with each said crossing thread, each said auxiliary thread and the crossing thread associated therewith being laterally interlaced to provide a sliding connection therebetween;

providing a separating element for preventing each said sliding connection from sliding so far towards a reed for said warp as to become incorporated in a fabric thereby being woven, said separating element being disposed substantially perpendicular to said weaving plane, and, disposed upstream of said reed along said warp;

operating said separating element in contact with said crossing and auxiliary threads of said warp, while opening a succession of sheds in said warp and inserting a respective succession of wefts along said weaving plane transversally of said warp through said sheds, and alternately tensioning and releasing said crossing and auxiliary threads in coordination with opening said succession of sheds, for alternately moving each said crossing thread across, and back, in relation to an associated said stationary thread.

2. The method of claim 1, further including the subsequent step of:

withdrawing said stationary thread from said fabric.

3. The method of claim 1, further including the subsequent step of:

withdrawing said auxiliary thread from said fabric.

* * * * *